United States Patent [19]

Beckerer, Jr. et al.

[11] Patent Number: 4,648,435

[45] **Date of Patent: * Mar. 10, 1987**

[54] BOAT WINDOW

[75] Inventors: Frank S. Beckerer, Jr., 40 Dock Rd., Milford, Conn. 06460; William F. Spangler, Milford, Conn.

[73] Assignee: Frank S. Beckerer, Jr., Milford, Conn.

[ * ] Notice: The portion of the term of this patent subsequent to Feb. 25, 2003 has been disclaimed.

[21] Appl. No.: 789,779

[22] Filed: Oct. 21, 1985

Related U.S. Application Data

[63] Continuation-in-part of Ser. No. 515,470, Jul. 20, 1983, Pat. No. 4,572,266, and a continuation-in-part of Ser. No. 239,250, Mar. 2, 1981, abandoned.

[51] Int. Cl.[4] ..... E06B 3/30

[52] U.S. Cl. ..... 160/92

[58] Field of Search ..... 160/92

[56] References Cited

U.S. PATENT DOCUMENTS

| | | | |
|---|---|---|---|
| 304,183 | 8/1884 | Davis | 160/44 X |
| 362,051 | 5/1887 | Addoms | 160/92 |
| 1,125,805 | 1/1915 | Brock | 160/89 X |
| 1,521,915 | 1/1925 | St. Pierr et al. | 160/DIG. 3 |
| 1,584,475 | 5/1926 | Rumpler | 160/92 |
| 1,595,274 | 8/1926 | White | 160/DIG. 2 |
| 1,616,297 | 2/1927 | Alber | 160/89 |
| 1,690,094 | 12/1928 | Beers | 160/92 |
| 1,776,285 | 9/1930 | Herbest | 160/44 |
| 1,780,492 | 11/1930 | Malm | 160/44 |
| 2,179,541 | 11/1939 | Burke | 160/89 |
| 2,627,912 | 2/1953 | Soppeland | 160/44 X |
| 2,962,137 | 11/1960 | Milavec | 160/104 |
| 3,771,582 | 11/1973 | Hairston | 160/89 |
| 4,095,640 | 6/1978 | Beckerer | 160/92 |
| 4,125,141 | 11/1978 | Stilwell | 160/44 |
| 4,267,874 | 5/1981 | Pope | 160/92 |
| 4,572,266 | 2/1986 | Beckerer, Jr. et al. | 160/92 |

*Primary Examiner*—Ramon S. Britts
*Assistant Examiner*—Cherney S. Lieberman
*Attorney, Agent, or Firm*—H. Gibner Lehmann; K. Gibner Lehmann

[57] ABSTRACT

A boat window having a removable screen which, in one embodiment, directly carries a louver and which can be easily installed in the window frame or removed therefrom as a single unit, so as to facilitate replacement with a conventional window screen, if desired. The louver forms a water shield which directly engages the screen frame adjacent to its top edge, so as to reduce the likelihood of water splashing through upper portions of the screen. The window comprises a frame body having a mounting flange and spigot, for installation in an opening in the boat hull. A window pane is hingedly connected to the mounting flange, and adapted to close off the space formed by the spigot. Most or all portions of the louver lie within the confines of the spigot, so as not to protrude any substantial extent, thereby reducing the likelihood of damage to the louver from inadvertent contact with other objects.

12 Claims, 19 Drawing Figures

Fig. 3
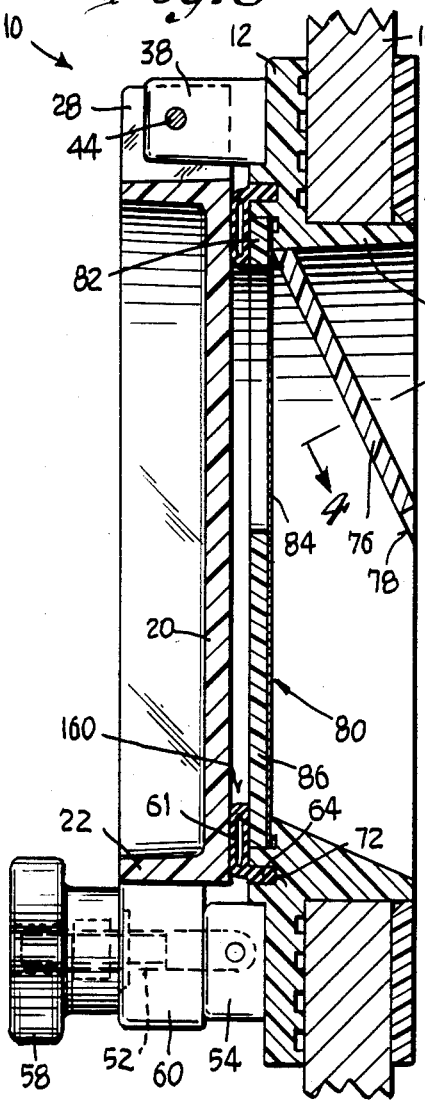
Fig. 5
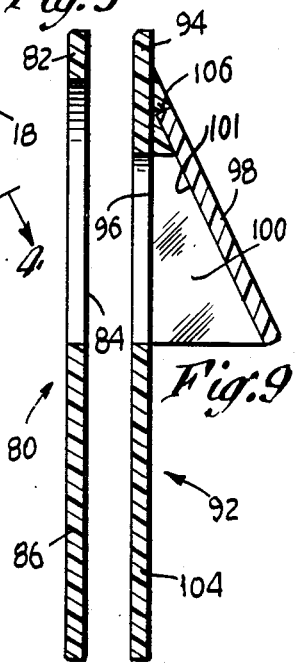
Fig. 9
Fig. 8
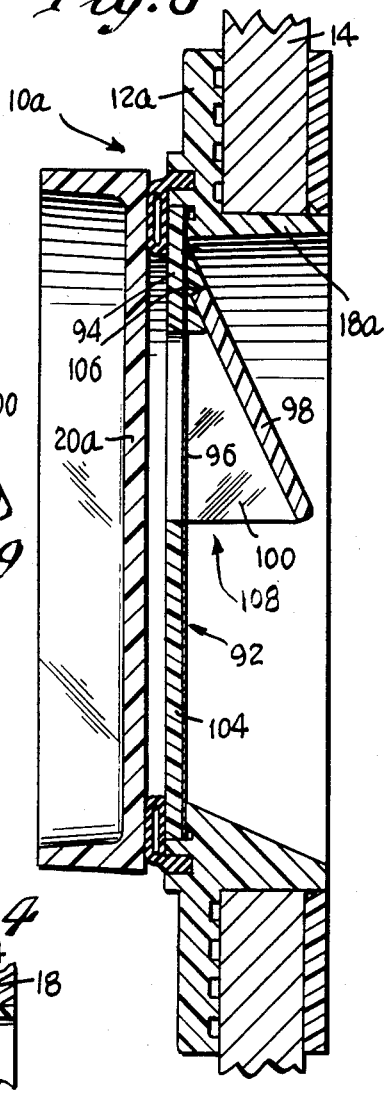
Fig. 4
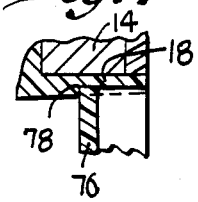
Fig. 6
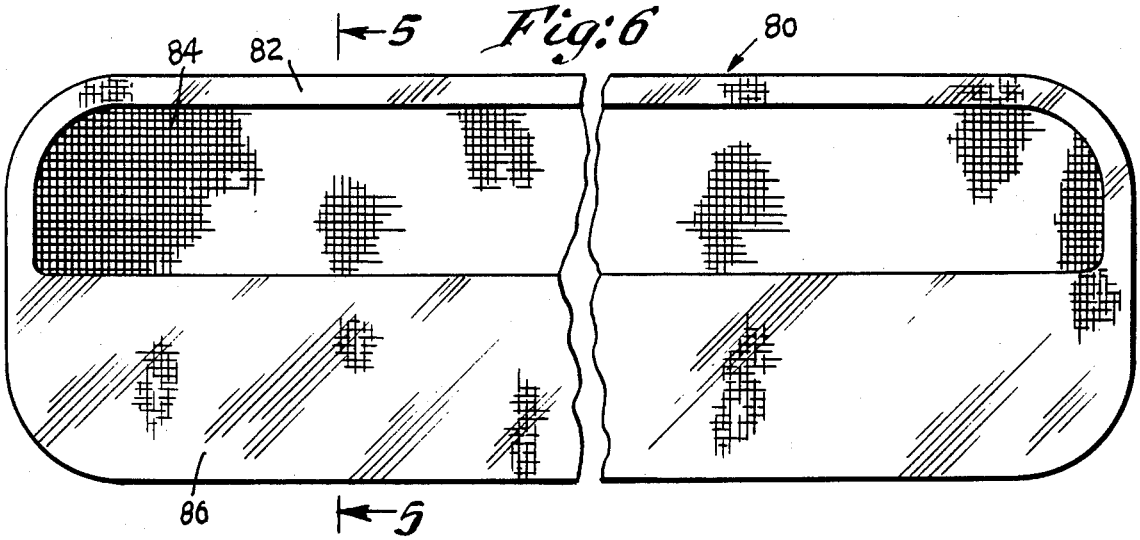

15
16
112
114
116
118
120
122
124
126
128
130
132
134
136
138
140
142
144
146
160
10b
12b
18b
20b

BOAT WINDOW

This application is a continuation-in-part of our copending application, U.S. Ser. No. 515,470 filed July 20, 1983, now U.S. Pat. No. 4,572,266 and U.S. Ser. No. 239,250 filed Mar. 2, 1981, now abandoned.

This invention relates generally to boat window constructions, and more particularly to arrangements which are especially intended to minimize the possibility of water from splashes or rain entering the boat interior.

In particular, the present invention relates to improvements in the construction which is illustrated and described in applicant's U.S. Pat. No. 4,095,640 dated June 20, 1978, and entitled BOAT WINDOW.

The window which is the subject of the above patent contains a number of features which have been found to be advantageous from the standpoint of reducing the tendency for trapped water to run into the interior of the boat when the window is opened. The feature of the sloping sill tends to channel splashes outwardly, in a direction away from the transparent pane. The arrangement of the gasket which seals against the pane functions to minimize the possibility of water collecting around and above the gasket, thereby further reducing leakage.

Where mesh type screens of the type illustrated are incorporated in the window, there still existed the possibility of windswept rain or splashes entering the window when the pane was open. Several attempts to solve this problem have been proposed in the recent past. Most prior constructions have incorporated an external or exterior, protruding awning of some type. These were usually in the form of a housing which was secured to the spigot of the window and which extended outwardly therefrom. Such external structures were usually removable, and were fastened with either screws or by means of a snap fit.

One of the problems with the above arrangements was that the devices tended to be rather bulky, and furthermore, by virtue of their size there existed the possibility of their being damaged in the event that the boat inadvertently came in contact with another object, such as a piling, pier, dock, etc. When this occurred, the structure was usually broken or badly deformed, necessitating complete removal and replacement.

When such external awnings were employed with windows that were installed in the cabins of sailboats, the awnings protruded into the deck area surrounding the cabins, and were thus likely to either snag lines, or be inadvertently bumped by personnel on the deck. In some cases this construction constituted a safety hazard, since the housings or awnings were sometimes fragile and could break, leaving jagged edges that could cause injury. Alternately, a person's foot could become caught under the awning, possibly leading to twisted ankles or other injury, etc.

SUMMARY

The above disadvantages and drawbacks of prior rain shield arrangements are largely obviated by the present invention which has for an object the provision of a novel and improved boat window which is relatively simple in construction, reliable in operation, and especially convenient in use.

A related object is the provision of a window as above characterized, wherein virtually no part of the shield extends any substantial extent past the confines of the spigot of the window, thereby minimizing the possibility of the shield being inadvertently damaged due to bumping, jarring, etc.

Still another object is the provision of a window construction incorporating a rain shield which can be readily removed from inside the boat, as desired, to enable greater flow of air into the boat through the window if the shield is not needed on a particular day.

Yet another object of the invention is the provision of a water shield which is incorporated into a mesh screen that is removably carried by the window, such that a conventional screen can be incorporated in the window as desired, without any modification of the existing window structure.

A still further object is the provision of a window construction which is constituted of parts that are capable of being molded of plastic, thereby minimizing the overall manufacturing costs, and reducing the time that is required to assemble the window.

Still another object is the provision of a window having an effective rain shield, but which enables a substantial flow of air to be achieved, such that the circulation provided by the window is not completely lost when the water shield is installed.

Yet another object of the invention is the provision of a rain shield which can be substantially transparent, thereby not adversely cutting down the amount of light that can enter the interior through the boat window when the shield is in place.

The above objects are accomplished in one embodiment, by the provision of a boat window comprising a frame body with a mounting flange for engagement with an inner surface surrounding an opening in the wall of a boat, a spigot connected with the flange and adapted to extend through the opening, and a hingedly mounted window pane. There is further provided a removable window screen comprising a screen frame, carried by the frame body, and an elongate water shield directly carried by the screen frame and connected thereto near or at its top edge so as to reduce splashing of water through upper portions of the screen. The screen frame and elongate water shield are removable from the frame body as a single unit, such that the window can be equipped with a conventional screen, as desired.

The above objects are accomplished in another embodiment by a boat window, comprising a frame body with a mounting flange for engagement with an inner surface surrounding an opening in the wall of a boat, a spigot connected with the flange and adapted to extend through the opening, and a hingedly mounted window pane. There is further provided a removable window screen comprising a screen frame, carried by the frame body, and an elongate water shield directly carried by the spigot. The water shield has a top edge which is closely juxtaposed to the inner edge of the top portion of the spigot, and a bottom edge which extends toward the outer edge of the spigot, so as to prevent water from splashing through the upper part of the mesh of the screen. The location of the elongate shield is such that it forms a hood over the upper portion of the screen when the latter is in place, but does not interfere substantially with the flow of air through the window. By optionally making the elongate shield transparent, normal visibility through the window is relatively unimpeded.

In yet another embodiment, the objects are accomplished by a boat window, comprising a frame body with a mounting flange for engagement with an inner surface surrounding an opening in the wall of a boat, a spigot connected with the flange and adapted to extend through the wall opening, and a hingedly mounted window pane. There is further provided a removable window screen comprising a screen frame carried by the frame body and being of sheet-like construction, comprising a substantially flat vertical water shield extending across the lower portion of the screen and a mesh extending between the vertical shield and the upper edge of the screen. The vertical shield prevents splashes from entering the boat through the lower portion of the screen, while the mesh enables air to circulate through its upper portion. As in the previous embodiment, the screen frame and vertical water shield are removable from the frame body as a single unit, such that the window can be readily equipped with a conventional screen.

With the above constructions involving water shields that are directly carried by the screen frame, great flexibility can be realized in that it is possible, from inside the boat, to remove an existing screen of conventional construction and replace it with a new unit that employs the shield. This procedure can be accomplished quickly and easily, typically within a minute or less.

In addition, by the present arrangement it will be possible to incorporate new screens having water shields in existing boat window constructions of the type having a removable screen frame. Examples of boat windows of this kind are illustrated and described in applicant's U.S. Pat. No. 4,095,640 mentioned above, as well as in copending application, U.S. Ser. No. 203,046 filed Nov. 3, 1980, entitled SELF-DRAINING BOAT WINDOW, in the name of Frank S. Beckerer. Accordingly, the benefits of the screen construction of the present invention can be incorporated rather easily into window installations of previous construction or design, substantially without any modification of the original structure. This is considered to be an important feature of the present invention.

By virtue of the fact that the various water shield arrangements to be described are either directly carried by the screen or disposed mostly within the confines of the spigot, the possibility of their being damaged due to inadvertent bumping, jarring, etc., is greatly minimized. Such inadvertent damage had been a problem in some prior window constructions for boats, particularly those incorporating an external hood which fitted over the exterior of the window. These were prone to damage or breakage in the event that they came into contact with a dock, piling, etc. The present construction eliminates such a possibility.

Also by the present invention there are eliminated the hazards mentioned above relating to injury from jagged pieces of plastic from a broken awning. Since virtually all portions of the improved shield of the present invention lie substantially completely within the confines of the spigot, the likelihood of breakage of the shield is virtually eliminated. Problems with snagging of lines, and with the possibility of injury from someone's foot being caught under an awning-type structure are also completely circumvented by the present arrangement.

Other features and advantages will hereinafter appear.

In the drawings, illustrating several embodiments of the invention:

FIG. 3 is a section taken on line 3—3 of FIG. 1.

FIG. 4 is a section taken on line 4—4 of FIG. 3.

FIG. 5 is a vertical section of the screen per se, taken on line 5—5 of FIG. 6, showing a water shield directly carried by, its frame so as to eliminate water splashes through lower portions of the screen.

FIG. 6 is a front elevational view of the screen of FIG. 5 particularly showing a mesh carried thereby, and illustrating the water shield of the lower portion of the frame.

FIG. 8 is a section taken on the line 8—8 of FIG. 7.

FIG. 9 is a vertical section of the screen per se, taken on the line 9—9 of FIG. 10, showing one water shield carried at the top edge thereof.

FIG. 13 is a top plan view of the screen frame of FIG. 10, with one water shield removed.

Figures 14, 15, 16, 17:
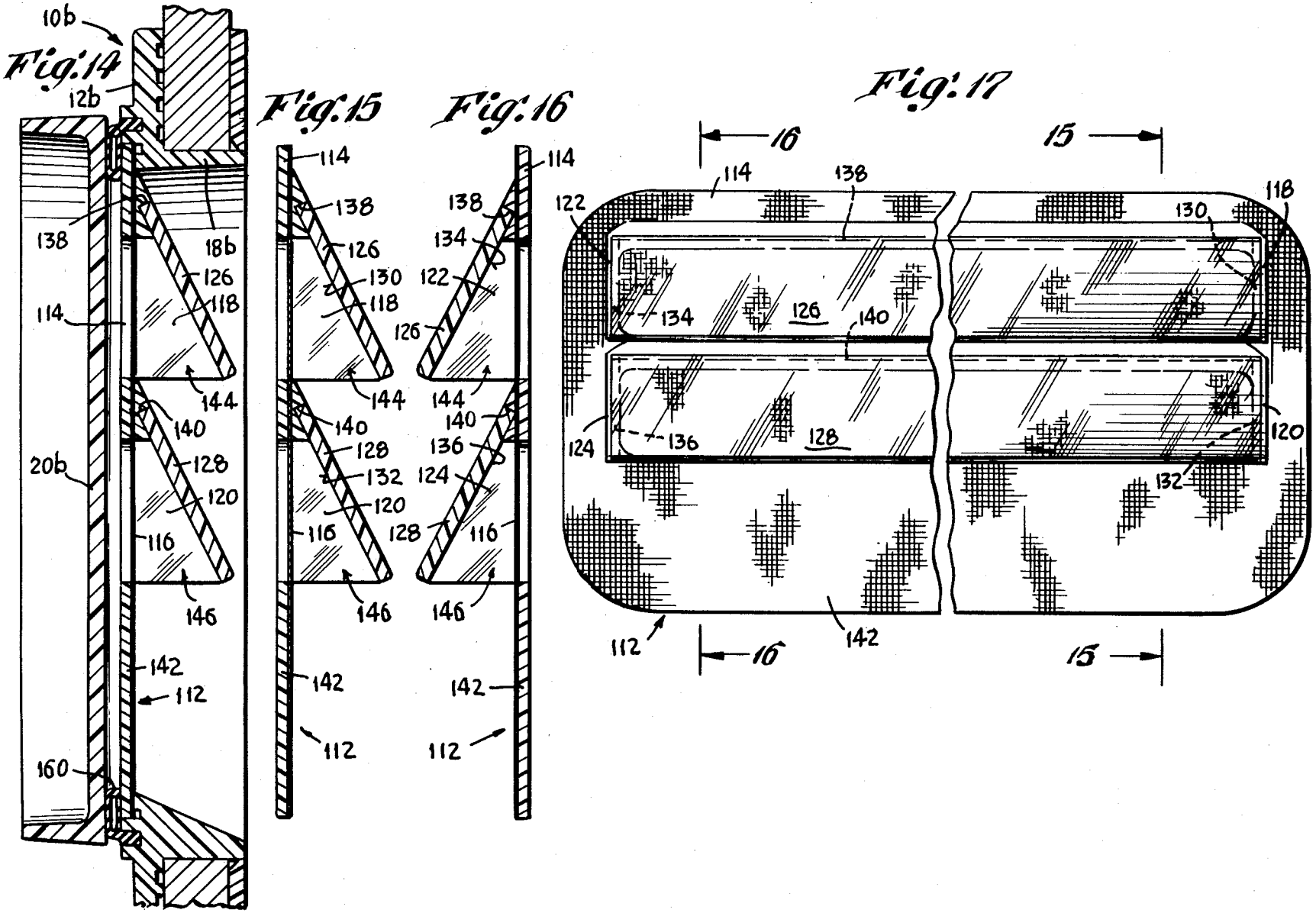

FIG. 14 is a vertical section of a somewhat modified window, of larger physical size and incorporating a removable screen which carries a pair of angularly disposed water shields disposed one above the other, so as to reduce the likelihood of splashes through the upper portions of the screen while at the same time not significantly impeding either air flow through the window, or visibility therethrough.

Figure 15:
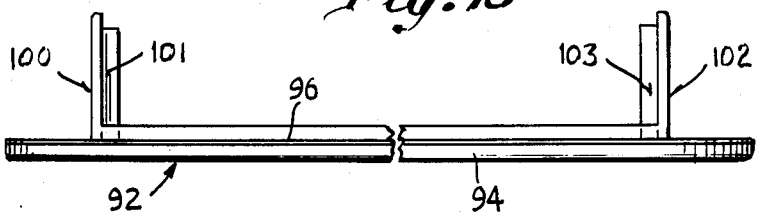

FIG. 15 is a vertical section of the screen of FIG. 14, taken on the line 15—15 of FIG. 17.

FIG. 16 is a vertical section of the screen of FIG. 14, taken on the line 16—16 of FIG. 17, and FIG. 17 is a front elevational view of the screen of the window of FIG. 14.

Figure 18:
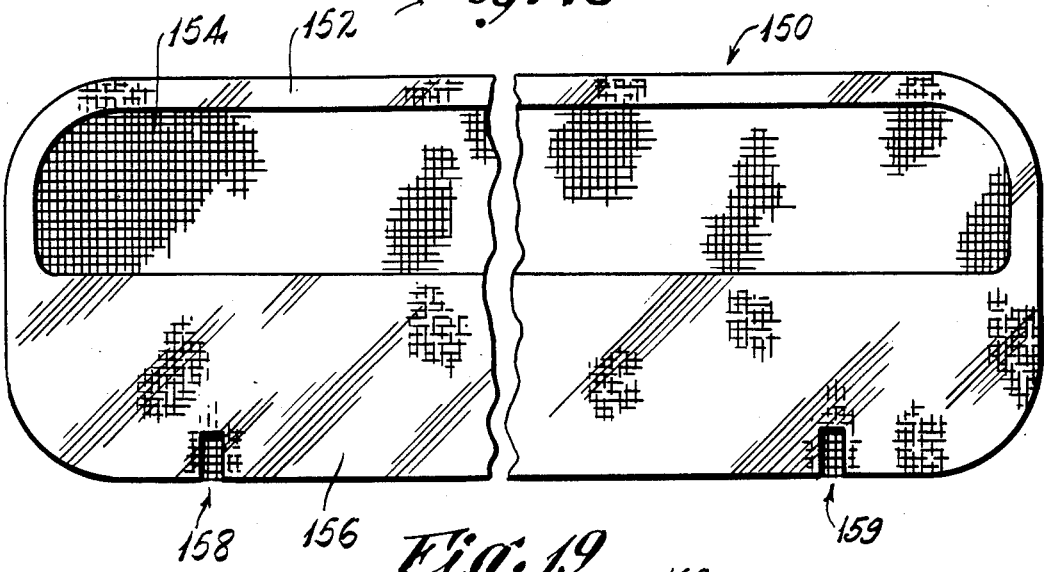

FIG. 18 is a front elevational view similar to FIG. 6, of a modified screen, particularly showing the mesh thereof, and illustrating the water shield of the lower portion of the frame. The modified screen has drainage notches in its periphery, and constitutes another embodiment of the invention.

Figure 19:
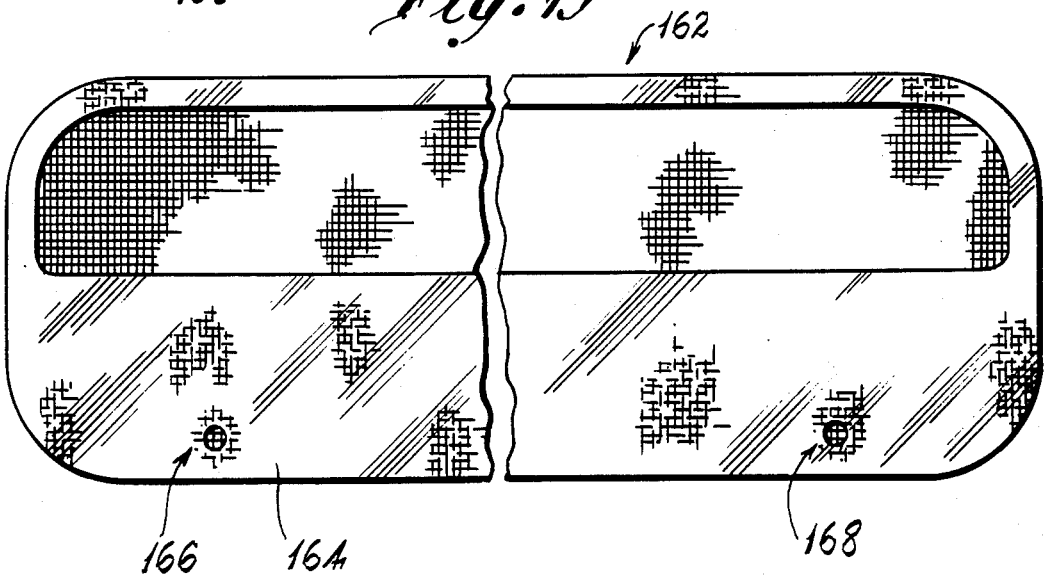

FIG. 19 is a view like that of FIG. 18, except showing the further modified screen, having drainage passages in the form of drain holes, adjacent its periphery, this construction constituting another embodiment of the invention.

Figure 1:
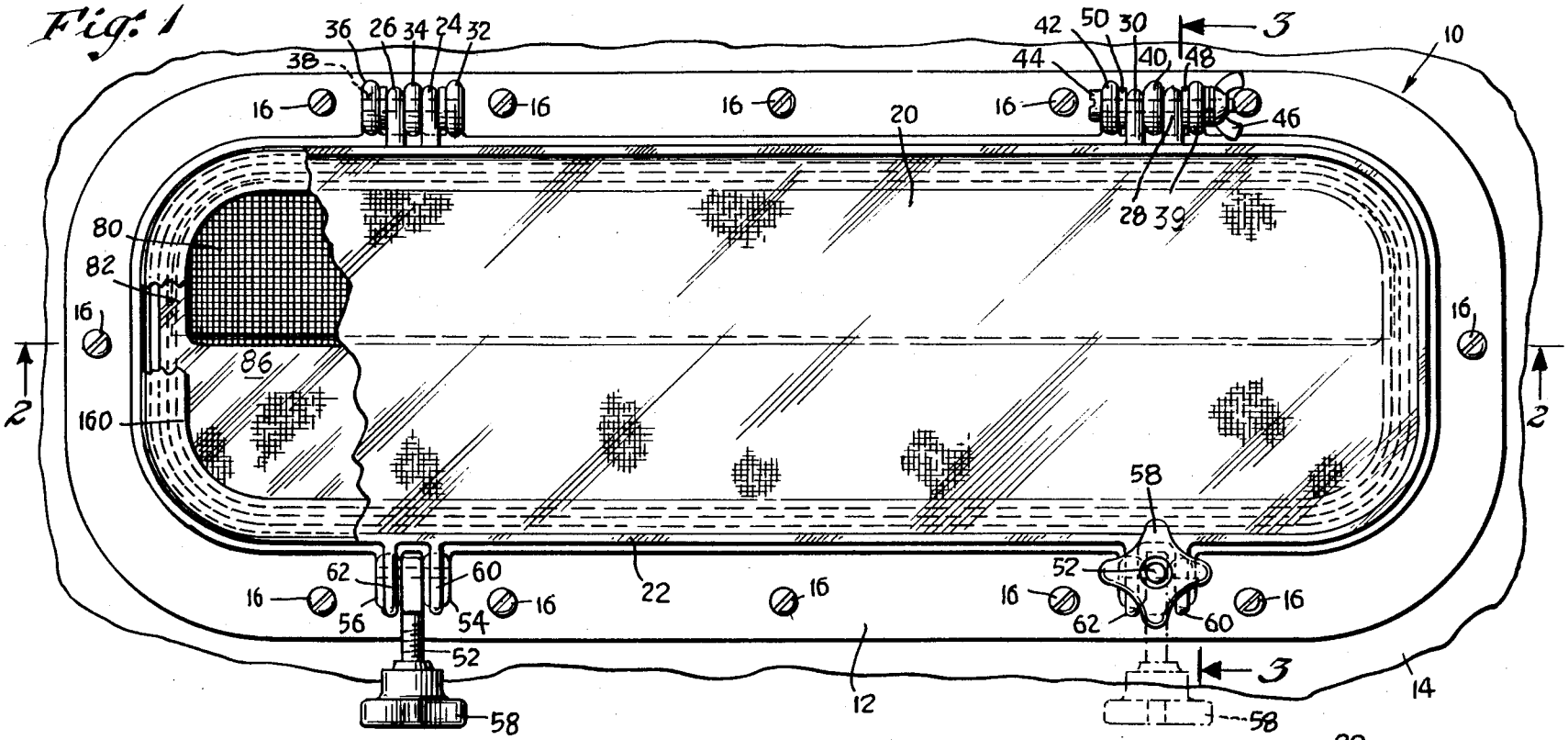
FIG. 1 is a front elevational view, partially broken away of the improved boat window the present invention.
Figure 2:
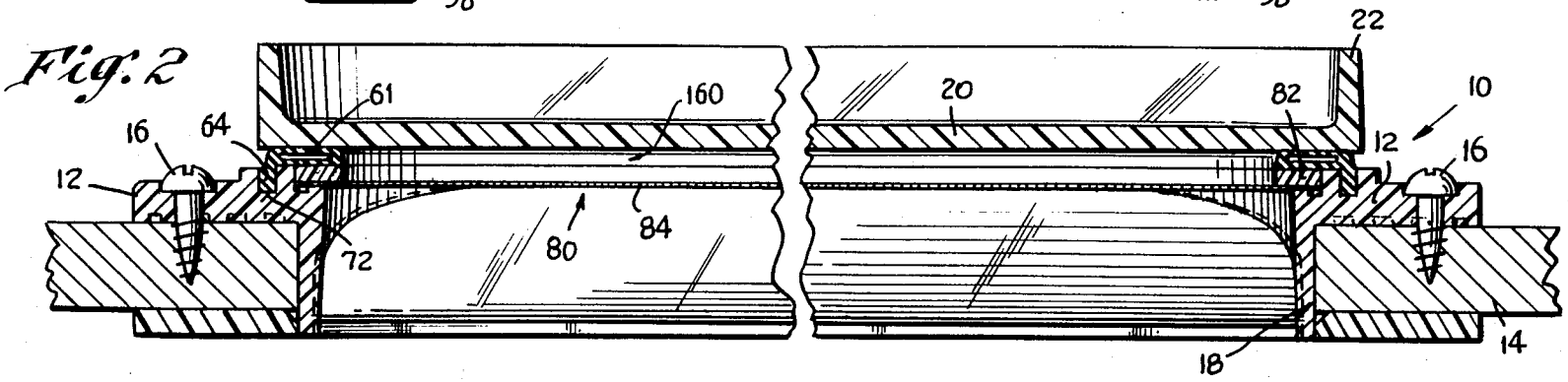
FIG. 2 is a section taken on line 2—2 of FIG. 1.

FIGS. 1-3 show a boat window generally designated by the numeral 10, for installation in a suitable porthole or opening of a boat hull. The window construction includes a continuous frame body having a mounting flange 12 which seats against the inner surface of the boat hull 14 as shown in FIGS. 2 and 3, being secured in place by means of multiple screws 16. The body further includes a spigot or spigot wall 18 connected with the mounting flange and adapted to extend through the opening formed in the hull 14. The flange 12 and spigot 18 are constituted of molded plastic and are formed integral with one another. There is also provided a molded plastic window pane 20, preferably transparent, which is hingedly connected to the mounting flange 2 as shown in FIG. 1. The pane 20 has a peripheral flange portion 22 with a pair of hinge lugs 24, 26 pivotally secured to cooperable hinge lugs 32, 34, 36 by means of a spring-type hinge pin 38. A second pair of hinge lugs 28, 30 is pivotally secured to cooperable hinge lugs 39, 40, 42 of the flange 12 by a hinge pin in the form of a screw 44 including a wing nut 46. In addition, two resilient washers 48, 50 are provided, against which adjacent portions of the lugs bear when the wing nut 46 is tightened. Such a construction enables the window to be opened and held in such open position against the action of gravity.

Means are provided on the flange 12 and pane 20 for latching the latter in a closed position wherein the opening formed by the spigot 18 is closed off. As illustrated in FIG. 1, two latches are provided, each comprising a swivel arm 52 carried on a pin extending through aligned lugs 54, 56, the end of the arm 52 being threaded and carrying a knob 58 of molded plastic construction. During the manufacture of this knob 58, a nut is incorporated and held captive, for engagement with the threads of the swivel arm 52. The flange 22 of the pane 20 includes pairs of lugs 60, 62 which are adapted to overlie the lugs 54, 56 when the window is in the closed position of FIG. 1. By such an arrangement, the arm 52 can be swung to a position wherein the knob 58 overlies the lugs 60, 62, after which the knob can be tightened on the arm 52 so as to secure the window in a closed position, as in FIG. 3. It will be understood that the right hand latch mechanism in FIG. 1 is shown in solid lines, in the latched position, the knob 58 having been tightened.

Referring particularly to FIGS. 2 and 3, there is illustrated a gasket construction generally designated by the numeral 160. The gasket 160 is resilient and has a portion 61 of generally oval cross-sectional configuration, with an inner space. Secured at one edge of the gasket 160 is a protruding rib 64 connected to the oval portion 61 by means of a thin web. The gasket 160 can be constituted of resilient material similar to that manufactured under the trademark "Nordel", by Dupont.

As shown, the mounting flange 12 has a peripheral groove 72 which is adapted to receive the protruding rib 64 of the gasket 160. During such assembly the rib 64 is merely pressed into the groove 72, and frictionally grips the opposite walls thereof, tending to prevent inadvertent removal. During manufacture, the gasket is formed by extrusion and cut into predetermined lengths of the proper size, and the ends joined together into a continuous loop by suitable cement. The gasket loop is then installed on the mounting flange 12 such that it surrounds the rectangular window opening, in FIG. 1.

Assembly of the gasket is greatly facilitated by the provision of the protruding rib 64 and groove 72, such assembly requiring neither skilled personnel nor special equipment. Should replacement of the gasket ever be required, it can be readily removed by exerting additional force in an outward direction. The force required to remove the gasket, however, is considerably greater than that normally exerted on it under conditions of normal use. Accordingly, it tends to stay in its proper position under the action of the rib, all without requiring special adhesives, cement, or the like.

In accordance with the present invention there is provided a novel arrangement for reducing the likelihood of wind driven rain or water splashes from entering through the window 10 when the pane 20 is in the open position. In accomplishing this, there is provided a substantially flat, preferably transparent elongate water shield 76 disposed within the spigot 18 of the window, and joined to the upper portion of the spigot as shown in FIG. 3, such as by suitable cement or the like. The shield 76 also engages and is supported by the opposite side walls of the spigot 18, and is skewed with respect to the plane of the mounting flange 12. The elongate shield 76 can be positioned against a pair of ledges 78, one of which is shown in FIG. 4, so as to facilitate proper positioning of the shield during manufacture. As can be readily seen, essentially all portions of the elongate shield 76 are disposed within the confines of the spigot 18 so as to minimize the likelihood of inadvertent bumping or jarring of the same. This shield can be in the form of a plane sheet of clear plastic, cemented to the spigot wall 18 where it rests on the ledges 78.

Further in accordance with the invention, there is provided a screen generally designated by the numeral 80, comprising a screen frame 82 which carries a mesh 84 of usual construction, and which further has an integral vertical water shield 86 that is preferably transparent. With the construction of FIG. 3, the mesh 84 is seen to be superposed over the transparent vertical shield 86, but if desired, the mesh 84 could terminate at a point near the upper edge of the vertical shield 86, such that the latter would be free of distortion, so as to provide improved visibility.

The screen 80 is secured between the spigot 18 and the gasket 160. The gasket 160 is of sufficient stiffness such that the screen is held even when the pane 20 is open, as can be readily understood.

With the above construction, it can be seen that the first or elongate shield 76 forms a hood having a downwardly facing passage or opening through which circulating air can enter the open window through the mesh 84, with the tendency for rain or water splashes to enter the window through the mesh 84 being greatly minimized. This result is obtained substantially without reduced visibility through the window, especially where shields 76 and 86 are constituted of clear substance. During manufacture of the screen 80, the frame 82 and shield 86 would be molded as a single piece of clear substance, with the mesh 84 incorporated in the mold so as to be retained in the finished product. The screen per se is shown in FIGS. 5 and 6.

In fair weather, should it be desired that additional air flow be provided, it is a relatively simple matter to remove the screen 80 having the vertical water shield 86, by first removing the gasket 160 and thereafter substituting a conventional screen without the vertical shield 86, of the type shown in U.S. Pat. No. 4,095,640 identified above. Such a substitution can be easily accomplished from inside the boat and with a minimum of time and effort. With this arrangement, however, the elongate shield 76 would remain in its fixed position, regardless of the type of screen that were to be employed.

Figure 7:
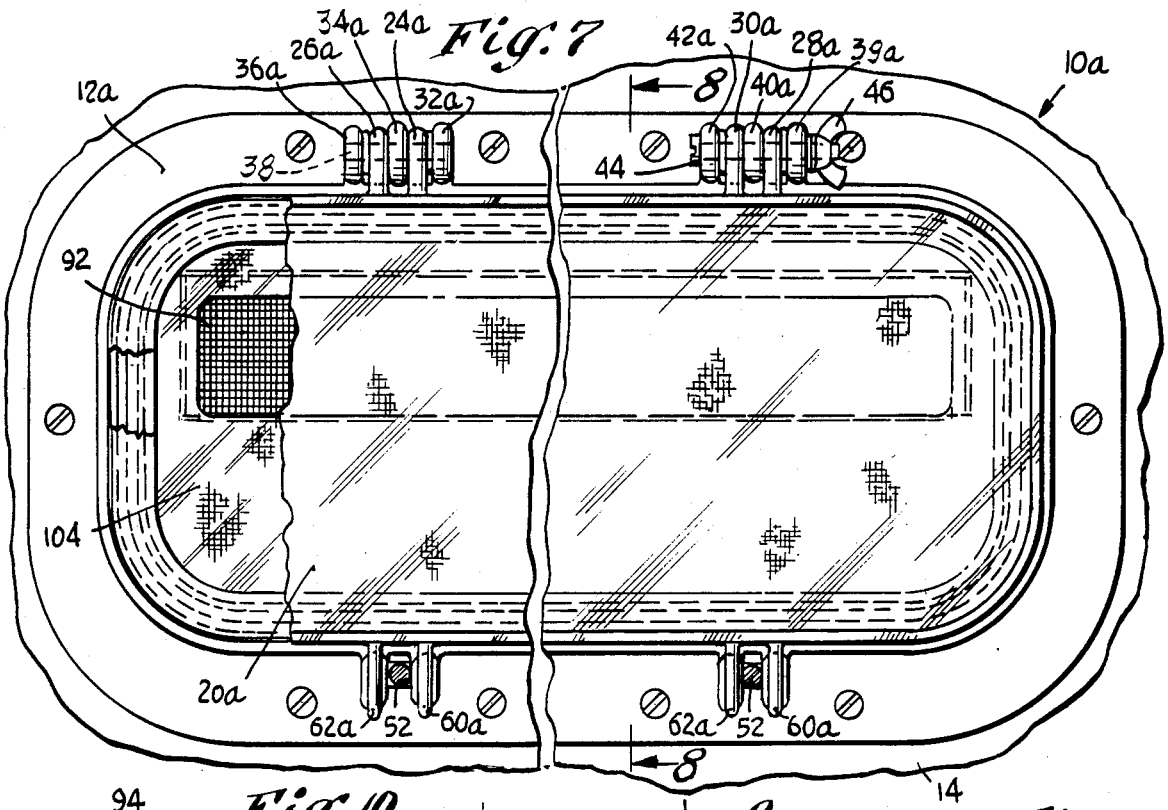
FIG. 7 is a front elevational view, partially broken away, of a somewhat modified window construction incorporating two water shields directly carried by the screen that is associated with the window.

Another embodiment of the invention is shown in FIGS. 7–12. As in the previous embodiment, there is illustrated a boat window generally designated by the numeral 10*a*, comprising a mounting flange 12*a* which engages the inner surface of the boat hull, a spigot 18*a* which extends through the opening in the hull, and a transparent window pane 20*a*. The pane 20*a* is hinged to the mounting flange as shown in FIG. 7, by means of hinges 24*a*, 26*a*, 28*a*, 30*a*, and 32*a*, 34*a*, 36*a*, and 39*a*, 40*a*, 42*a*. A hinge pin 38 is provided, as well as a screw 44 and a wing nut 46 similar to those of the first embodiment, for enabling swiveling or pivoting movement of pane 20*a*. A latch mechanism comprising a pair of swivel pins 52 and lugs 60*a*, 62*a*, is similar in construction to that of the previous embodiment. The knobs 58 that were illustrated in FIG. 1 have been eliminated from FIG. 7 in the interest of clarity.

In accordance with the present invention, there is provided on the window 10*a* a novel and improved arrangement for minimizing the likelihood of driven rain or water splashes from entering the interior of the boat when the pane 20*a* is opened. In accomplishing this objective, there is provided a screen 92 adapted to be removably carried by the spigot 18*a*, and held between the latter and a gasket 160. The screen is particularly illustrated in FIGS. 9–13 and comprises a screen frame 94, a mesh 96 of usual construction, and an elongate, upper horizontally-extending water shield 98 which is angularly disposed with respect to the plane of the screen frame 94.

Figure 11:
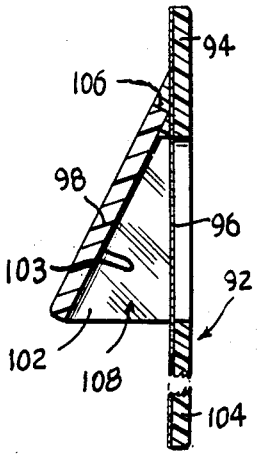
Fig. 11 is a section taken on the line 11—11 of FIG. 10.

As shown in FIGS. 9 and 11, there are provided at the opposite ends of the screen 92 a pair of triangularly shaped supports or ears 100, 102, which are preferably molded integral with the screen frame 94, and which are disposed in planes generally perpendicular thereto. The elongate shield 98 is preferably in the form of a sheet of transparent material, which sets in angular formations 101, 103 on the ears or mounting supports 100, 102 respectively, and also on a shoulder 106 which is disposed near the top edge of the screen 92. These angular formations 101, 103 are particularly shown in FIG. 13. The mounting supports 100, 102 shield horizontally-spaced opposite end portions of the elongate mesh panel 96.

Figure 10:
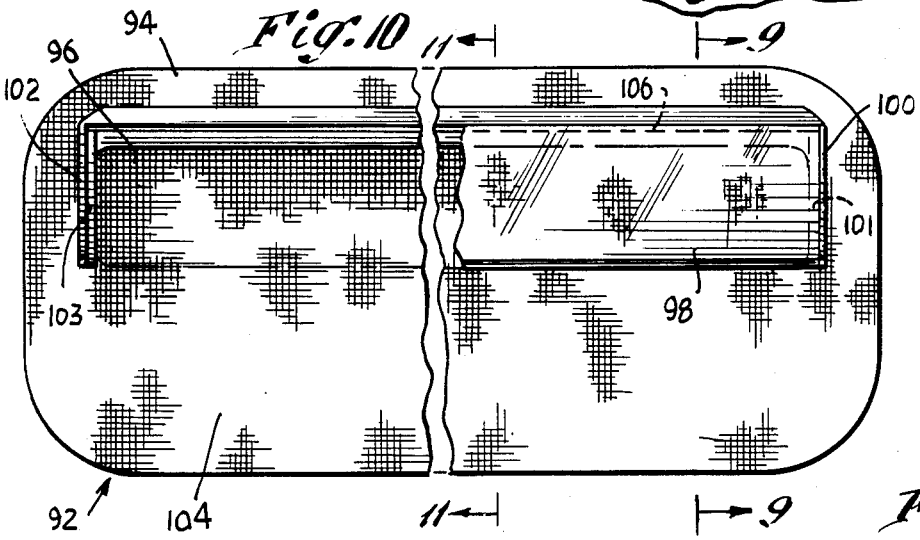
FIG. 10 is a front elevational view of the screen of the window of FIGS. 7 and 8.
Figure 12:
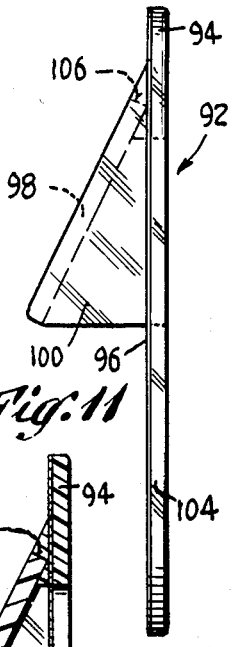
FIG. 12 is an end elevational view of the screen of FIG. 10.

The screen 92 further includes a vertical water shield 104, see FIGS. 7, 10 and 12, which is preferably transparent, and integral with the frame 94 and on which the mesh 96 can be superposed. Alternately, in order to improve the visibility through the shield portion 104, the mesh 96 can be terminated at a point adjacent to the middle of the screen 92.

With the present arrangement, it can be seen that the screen 92 is held in position by the gasket 160. The elongate shield 98 forms a hood with a downwardly facing opening 108 that will permit a limited amount of air to enter the open window through the mesh 96, but will effectively prevent water from entering therethrough, all without substantially limiting visibility.

The above construction has the important advantage of extreme simplicity and great flexibility. Due to the fact that all portions of the shields 98 and 104 are carried directly by the screen 92, it becomes a simple matter to install the screen 92 as desired, or to remove the same and substitute a screen of conventional construction, such as that shown in U.S. Pat. No. 4,095,640. As in the previous construction, substitutions can be made quickly and easily, from inside the boat. Furthermore, by virtue of the fact that most or all portions of the shields 98 and 104 lie substantially completely within the confines of the spigot 18*a*, the likelihood of these parts inadvertently coming into contact with objects such as pilings and piers, is greatly minimized.

A further advantage lies in the fact that the screen arrangement described above can be installed in an existing window, substantially without any modification of the latter being required. Accordingly, the invention has considerable importance as a retro-fit for window constructions of less modern design and that are already in use.

Still another embodiment of the invention is illustrated in FIGS. 14–17 which show a somewhat larger window incorporating a modified screen and water shield arrangement. In FIG. 14, the window is generally designated by the numeral 10*b*, comprising a mounting flange 12*b*, spigot 18*b* and pane 20*b*. The latter is hingedly connected to the mounting flange 12*b* as in the previous embodiments, but the hinge latch mechanisms have been omitted from FIG. 14 in the interest of clarity.

A sealing gasket 160 is provided, to be engaged by the pane 20*b* when the latter is closed.

In accordance with the present invention there is provided a unique arrangement for reducing the entry of water into the boat when pane 20*b* is open, comprising a screen generally designated 112, having a screen frame 114 and a mesh 116 of usual construction. As in the prior constructions the screen 112 is held in position against the spigot 18*b* by means of the gasket 160.

Integral with the screen frame 114 is a pair of upstanding triangular supports 118, 120 and 122, 124, which respectively support a pair of elongate water shields 126 and 128. The supports 118, 120 are provided with small ledges 130, 132, with the supports 122, 124 similarly being provided with ledges 134, 136, these engaging the ends of the elongate shields 126 and 128. The latter are preferably cemented in place, as shown. The upper edges of the shields 126, 128 rest against shoulders 138, 140 respectively, as particularly shown in FIGS. 15 and 16.

The lower portion of the screen 112 has a vertical water shield 142, such that there are formed a pair of downwardly facing openings 144, 146 through which circulating air can enter the window. Preferably the screen frame 114, vertical shield 142, and triangular supports 118, 120, 122, 124 are molded as a single integral piece, with the mesh 116 being encapsulated therein adjacent to the surface of the vertical shield 142. If desired, the mesh 116 could be terminated adjacent the location of the opening 146, so as to improve visibility through the vertical shield 142.

The above construction is seen to have all of the advantages of the previous constructions. That is, all parts of the water shields are disposed mostly within the confines of spigot 18*b*, thereby reducing the likelihood of damage to the individual parts. Also, by virtue of the fact that the water shields 126, 128 and 142 are carried entirely by the screen 112, and since removal is quickly and easily effected, a substitute screen of generally conventional construction can be installed in the window, if desired. Also, the screen of FIGS. 14–17 can be readily installed in an existing window construction of older design, since there would be required no modification of the spigot 18*b*, mounting flange 12*b* or window pane 20*b* per se.

Another embodiment of the invention is illustrated in FIG. 18, showing a screen 150 intended to be substituted for the screen 80 in the embodiment of FIGS. 1–6. The screen 150 comprises a screen frame 152 which carries a mesh 154, and has an integral vertical water shield 156. With the construction shown, the mesh is superposed over the transparent vertical shield, but if desired the mesh could terminate near the upper end of the shield.

By the present invention there are provided multiple drain passages constituted as notches in the periphery of the vertical shield 156, and designated 158 and 159. When the screen of FIG. 18 is substituted for the screen of FIG. 6 in the construction of FIG. 1, the drain notches provide a path by which water that has become trapped in the area immediately above the gasket 160 and between the pane 20 and the shield 86 in FIG. 3 to drain onto the sloping lower surface of the spigot 18. Accordingly, when the pane 20 is opened there is no accumulation of trapped water in this space which could otherwise enter the interior of the boat.

A still further modification of the screen construction is shown in FIG. 19. The screen 162 has an integral vertical water shield 164, which contains two drain holes 166 and 168. These function in a manner identical to that of the drain notches 158 and 159 of the screen 150 of FIG. 18. When the screen 162 is substituted in the construction of FIGS. 1–6, any water which has become trapped between the pane 20 and the shield 164 will be effectively channeled away, and onto the sloping lower surface of the spigot 18.

While the construction illustrated in FIGS. 18 and 19 show the mesh of the screen extending across the notches 158, 159, and the holes 166, 168, it will be understood that the mesh could be easily removed from these passages by trimming, or alternately, when the screen is molded, the screen mesh could be arranged so as to not extend over these areas.

All of the window constructions disclosed above have the following important advantage which was not enjoyed by the devices of the prior art. In almost all prior boat windows, it was absolutely necessary to keep the windows completely closed when the boat was not in use, in order to prevent rain from being driven into the boat interior. This had the distinct disadvantage of preventing desirable ventilation, and thus encouraging the formation of mildew. In sailboats where the windows were installed in the cabin, they were disposed at a slight angle with respect to the vertical, generally on the order of 5°–30°. With such arrangements it was essential to keep the windows closed when the boat was not in use, failing which a water problem was certain to occur.

However, with the present arrangement it is not essential to keep the window closed, since the shield constructions described above have been found to be very effective in preventing water from entering the boat interior, even with the window pane completely open. Accordingly, the window can provide effective protection against leakage while at the same time enabling a degree of ventilation to be had. This is considered to be a very important feature of the present invention.

From the above it can be seen that we have provided a number of especially effective arrangements for dealing with leakage of water into the interior of a boat through the windows thereof, the various constructions being relatively simple and yet not adversely affecting either the free flow or air through the window or the visibility through the same. The various constructions are seen to be safe and damage resistant, as well as being relatively inexpensive to manufacture by virtue of the parts being molded as relatively simple pieces.

The above organizations are thus seen to represent a distinct advance and improvement in the technology of boating accessories.

Each and every one of the appended claims defines a distinct aspect of the invention separate from the others, and each claim is accordingly to be treated in this manner when the prior art devices are examined in any determination of novelty or validity.

Variations and modifications are possible without departing from the spirit of the invention.

What is claimed is:

1. A boat window, comprising in combination:

(a) a frame body comprising a mounting flange for engagement with an inner surface surrounding an opening in the wall of a boat, (b) said frame body including a spigot connected with the flange and defining the window opening, said spigot being adapted to extend through said wall opening of the boat, (c) a window pane for selectively closing off the window opening formed by the spigot, (d) means hingedly connecting said window pane to said mounting flange, (e) a removable window screen unit comprising a screen frame carried by the frame body of the boat window, said screen frame having in its lower portion a vertical water shield panel extending over and spanning the lower area of the screen frame to protect against splashes through the frame body when the window pane is open, (f) said window screen unit having a mesh panel disposed permanently essentially coplanar with said water shield panel and extending between said water shield panel and the upper edge of the screen frame, said mesh panel enabling air to circulate through the upper portion of the screen unit, (g) said vertical water shield panel having an upper edge which borders said mesh panel, (h) said screen unit further including an additional, horizontally-extending elongate water shield panel disposed obliquely with respect to the plane of the window screen frame and permanently and fixedly secured thereto along the upper edge of the screen frame and depending therefrom so as to form a hood having an opening facing in a generally downward direction, and (i) a pair of mounting supports joining said additional panel and said screen frame to each other at opposite ends of the additional panel and shielding opposite portions of the mesh panel, said mounting supports preventing inadvertent separation of the additional panel and the said frame and minimizing splashing of liquid through said portions of the mesh panel, (j) said screen unit being removable from the frame body of the boat window as a single unitary assemblage, such that the window can be optionally equipped instead with a conventional screen unit, as desired.

2. The invention as defined in claim 1, wherein:

(a) said frame body has a peripheral groove, (b) a sealing gasket carried in said groove and engageable with the window pane when the latter is closed, for preventing leakage, (c) said gasket having a portion normally overlying the screen frame so as to retain, against inadvertent dislodgement, the said window screen unit comprising the screen frame, vertical water shield panel, mesh panel, additional elongate panel and mounting supports therefor.

3. The invention as defined in claim 2, wherein:

(a) said gasket and screen unit are removable from the inside of the frame body of the window to enable the screen unit to be easily replaced.

4. The invention as defined in claim 1, wherein:
(a) the spigot forms a generally box-like space,
(b) all portions of the additional water shield panel lying completely within the confines of said space, so as to minimize the possibility of damage to the said additional shield panel due to inadvertent contact of the exterior of the boat with the dock, or with piers or pilings.

5. The invention as defined in claim 1, wherein:
(a) said screen unit further includes a third and elongate water shield panel carried directly by the screen frame in a fixed position thereon, and engaging the same at a location spaced from its top edge, said third and elongate water shield panel being disposed below the said additional elongate water shield panel, so as to reduce splashing of water through upper and middle portions of the screen unit,
(b) the immediately preceding two water shield panels constituting a pair of stationary louvers on the screen unit.

6. A boat window, comprising in combination:
(a) a frame body comprising a mounting flange for engagement with an inner surface surrounding an opening in the wall of a boat,
(b) said frame body including a spigot connected with the flange and defining the window opening, said spigot being adapted to extend through said wall opening of the boat,
(c) a window pane for selectively closing off the window opening formed by the spigot,
(d) means hingedly connecting said window pane to the said mounting flange,
(e) a removable window screen unit comprising a screen frame carried by the frame body of the boat window, said screen frame having in its lower portion a vertical water shield panel extending over and spanning the lower area of the screen frame to protect against splashes through the frame body when the window pane is open,
(f) said window screen unit having a mesh panel disposed permanently essentially coplanar with said water shield panel and extending between said vertical water shield panel and the upper edge of the screen frame, said mesh panel enabling air to circulate through the upper portion of the screen unit,
(g) said vertical water shield panel having an upper edge which borders said mesh panel,
(h) said screen unit being removable from the frame body of the boat window as a unitary assemblage, such that the window can be equipped instead with a conventional screen, as desired.

7. The invention as defined in claim 6, wherein:
(a) said frame body has a peripheral groove,
(b) a sealing gasket carried in said groove and engageable with the window pane when the latter is closed, for preventing leakage,
(c) said gasket having a portion normally overlying the screen frame so as to retain, against inadvertent dislodgement, the said window screen unit comprising the screen frame, vertical water shield panel, and mesh panel.

8. The invention as defined in claim 7, wherein:
(a) said gasket and screen unit are removable from the inside of the frame body of the window to enable the screen unit to be easily replaced.

9. A boat window, comprising in combination:
(a) a frame body comprising a mounting flange for engagement with an inner surface surrounding an opening in the wall of a boat,
(b) said frame body including a spigot connected with the flange and defining the window opening, said spigot being adapted to extend through said wall opening of the boat,
(c) a window pane for selectively closing off the window opening formed by the spigot,
(d) means hingedly connecting said window pane to said mounting flange,
(e) a removable window screen unit comprising a screen frame and a mesh panel, carried by the frame body of the boat window,
(f) an elongate water shield panel directly carried by and fixedly and immovably secured at its ends to the inner wall of the spigot of the frame body,
(g) said elongate water shield panel being disposed obliquely with respect to the plane of the screen frame, and having a top edge which is juxtaposed to the inner edge of the top portion of the spigot, and having a bottom edge which extends toward the outer edge of the spigot so as to constitute, with the side walls of the spigot, a stationary hood to prevent water from splashing through the upper part of the mesh panel of the screen unit,
(h) said removable window screen unit having a vertical water shield panel extending over and spanning the lower area of the screen frame to protect against splashes through the frame body when the window pane is open,
(i) said mesh panel extending between said vertical water shield panel and the upper edge of the screen frame, said mesh panel enabling air to circulate through the upper portion of the screen unit,
(j) said vertical water shield panel having an upper edge which borders said mesh panel,
(k) said screen unit comprising the screen frame, shield panel and mesh panel, being removable from the frame body of the boat window as a unitary assemblage, such that the window can be equipped instead with a conventional screen unit, as desired.

10. The invention as defined in claim 9, wherein:
(a) said screen frame has multiple drain notches in its periphery adjacent the location of its vertical water shield panel, to enable water that has become trapped between the vertical water shield panel and the window pane to be channeled to the spigot.

11. The invention as defined in claim 9, wherein:
(a) said screen frame has multiple drain holes adjacent its periphery and disposed in its vertical water shield panel, to enable water that has become trapped between the vertical shield panel and the window pane to be channeled to the spigot.

12. A boat window, comprising in combination:
(a) a frame body comprising a mounting flange for engagement with an inner surface surrounding an opening in the wall of a boat,
(b) said frame body including a spigot connected with the flange and defining the window opening, said spigot being of sufficient width to extend entirely through said wall opening of the boat,
(c) a window pane for selectively closing off the window opening formed by the spigot,
(d) means hingedly connecting said window pane to said mounting flange,
(e) a removable window screen unit comprising a screen frame carried by the frame body of the boat window, said screen frame having in its lower portion a vertical water shield panel extending over and spanning the lower area of the screen frame to protect against splashes through the frame body when the window pane is open, (f) said window screen unit having a mesh panel disposed permanently essentially coplanar with said water shield panel and extending between said water shield panel and the upper edge of the screen frame, said mesh panel enabling air to circulate through the upper portion of the screen unit, (g) said screen unit further including an additional, horizontally-extending elongate water shield panel disposed substantially entirely within said spigot and obliquely with respect to the plane of the window screen frame, and permanently and fixedly secured to the latter along the upper portion of the screen frame so as to form a hood, said hood having an opening facing generally in a downward direction, and (h) a pair of mounting supports joining opposite ends of said additional vertical water shield panel to said screen frame to prevent inadvertent separation of the additional water shield panel from the said frame, (i) said screen unit being removable from the frame body of the boat window as a single unitary assemblage whereby the window can be optionally equipped instead with a conventional screen unit, as desired.

* * * * *